US011610752B2

(12) United States Patent
Yuan

(10) Patent No.: US 11,610,752 B2
(45) Date of Patent: Mar. 21, 2023

(54) FAST SMART CIRCUIT BREAKER

(71) Applicant: Defang Yuan, Ottawa (CA)

(72) Inventor: Defang Yuan, Ottawa (CA)

( * ) Notice: Subject to any disclaimer, the term of this patent is extended or adjusted under 35 U.S.C. 154(b) by 0 days.

(21) Appl. No.: 17/308,025

(22) Filed: May 4, 2021

(65) Prior Publication Data

US 2022/0359143 A1 Nov. 10, 2022

(51) Int. Cl.

| | |
|---|---|
| ***H01H 85/02*** | (2006.01) |
| ***H01H 39/00*** | (2006.01) |
| ***H01H 85/46*** | (2006.01) |
| ***H01H 85/165*** | (2006.01) |

(52) U.S. Cl.

CPC ..... *H01H 85/0241* (2013.01); *H01H 39/006* (2013.01); *H01H 85/165* (2013.01); *H01H 85/46* (2013.01)

(58) Field of Classification Search

CPC ..... H01H 39/006; H01H 2039/008; H01H 85/0241; H01H 85/165; H01H 85/26; H01H 85/28; H01H 85/46

See application file for complete search history.

(56) References Cited

U.S. PATENT DOCUMENTS 3,728,583 A * 4/1973 Wickson ..... H02H 3/021 361/115
4,174,471 A * 11/1979 Ford ..... H01H 39/006 200/61.08
4,369,420 A * 1/1983 Blewitt ..... H01H 85/36 337/148
4,479,105 A * 10/1984 Banes ..... H01H 39/006 337/30
4,490,707 A * 12/1984 O'Leary ..... H01H 39/006 337/6
4,680,434 A * 7/1987 Skogmo ..... H01H 39/00 200/61.08
4,920,446 A * 4/1990 Pflanz ..... H01H 39/006 361/93.7
5,109,211 A * 4/1992 Huber ..... H01H 85/165 337/247
5,360,999 A * 11/1994 Upshaw ..... H01H 39/006 361/103
5,783,987 A * 7/1998 Kern ..... H01H 39/00 337/403
5,796,326 A * 8/1998 Benito ..... H01H 85/28 337/171
5,990,572 A * 11/1999 Yasukuni ..... H01H 39/006 180/271

(Continued)

*Primary Examiner* — Jacob R Crum

(57) ABSTRACT

A circuit breaker system is provided; the circuit breaker system comprises of a transformer, a capacitor, a pulse generator, a EBWF fuse and a VCB, the circuit breaker system can interrupt rated load current, overload current, surge load current and short-circuit load current within 100 microseconds. The on-state voltage drop of the circuit breaker system is below 0.1V. The circuit breaker system interrupts load current by injecting a non-resonant pulse current to reduce the current between the contacts of the VCB, and circuit breaker system interrupts higher load current by detonating the EBWF fuse to force an open-circuit. The EBWF fuse comprises a detonator in the low terminal and a contacting bellows in the upper terminal. The EBWF fuse can be engaged and dis-engaged by a fuse holder system.

20 Claims, 9 Drawing Sheets

(56) References Cited

U.S. PATENT DOCUMENTS

| | | | | |
|---|---|---|---|---|
| 6,118,639 | A * | 9/2000 | Goldstein | H02H 9/042 361/55 |
| 6,141,202 | A * | 10/2000 | Maeckel | H01H 85/46 337/5 |
| 6,295,930 | B1 * | 10/2001 | Kume | H01H 39/006 102/202.5 |
| 2006/0049027 | A1 * | 3/2006 | Iversen | H01H 39/006 200/61.8 |
| 2014/0251958 | A1 * | 9/2014 | Wang | H01H 33/662 218/137 |
| 2016/0126046 | A1 * | 5/2016 | Aarskog | H05K 5/068 337/205 |
| 2017/0023618 | A1 * | 1/2017 | Douglass | G01R 19/32 |
| 2017/0178844 | A1 * | 6/2017 | Ängquist | H02H 3/08 |
| 2018/0277325 | A1 * | 9/2018 | De Palma | H01H 71/1045 |
| 2018/0342862 | A1 * | 11/2018 | Zacher | H01H 39/006 |
| 2020/0243290 | A1 * | 7/2020 | Sax | F42B 3/006 |
| 2020/0411271 | A1 * | 12/2020 | Tokoyoda | H01H 33/596 |

* cited by examiner

FAST SMART CIRCUIT BREAKER

FIELD OF THE INVENTION

The present disclosure relates to circuit breaker. More specifically, the present disclosure relates to a fast circuit breaker which can interrupt a load circuit in a very short time and can limit fault or short-circuit current in 100 microseconds. The disclosed circuit breaker has a very low conducting resistance which is only a fraction of that of semiconductor circuit breakers. The circuit breaker can be used in both AC and DC medium to high voltage system.

BACKGROUND OF THE INVENTION

How to interrupt a higher DC current over 1000V is always a challenge in modern power systems. Higher and higher DC voltage power systems are used in a wider range of applications. There are certain disadvantages relating to prior art DC circuit breakers:

1) The interrupt speed, or switching time is too slow, it takes several milliseconds to cut off load current, and it is not fast enough to protect semiconductor loads; these loads usually prefer a interrupt speed of less than 100 microseconds;
2) For faster circuit breakers, HV semiconductor devices are used. But the on-state conducting resistance is too high both in semiconductor or semiconductor assisted circuit breakers, the voltage drop is usually over 1.4 volts;
3) The cost of a DC circuit breaker is very high.

Therefore, there remains a need for a novel DC circuit breaker, which has a very fast interrupt speed to protection semiconductor loads, and has a very low on-state resistance to reduce operation cost, and it is low cost in manufacturing.

There are many solutions for DC circuit breakers. SCIBREAK in Sweden developed a VSC (voltage source convertor) assisted resonant current circuit breaker, which can significantly reduce cut-off time and on-state resistance. But the SCIBREAK system cannot cut off high short circuit, or it is still not fast enough to protect semiconductor loads which usually need to be cut-off in several microseconds (us). SCIBREAK design and description can be reached at Researchgate Net and WWW.scibreak.com.

SUMMARY OF THE INVENTION

The present invention aims to achieve a novel DC circuit breaker which can:

1) Interrupt normal load current within 5 milliseconds (5 ms);
2) Interrupt fault current or short circuit within in 100 microseconds (100 us);
3) Be very low in on-state voltage drop, for example, 0.1V or lower in 3000 VDC system, the on-state resistance is below 10% in compared with semiconductor circuit breakers.
4) Be low in manufacturing cost.

In accordance with one aspect of the present invention, there is provided a pulse current assisted circuit breaker system which can interrupt normal load current with injecting of pulse current comprising:

a transformer, a capacitor with two terminals, a pulse generator with two output terminals, a first surge arrestor, a load switch with two contacts, wherein the transformer has a first coil and a second coil, each coil has two terminals, the two terminals of the first coil is connected to the two output terminals of the pulse generator, the injecting of the pulse current is performed by the pulse generator via the transformer, wherein a first terminal of the second coil is connected to a first terminal of the capacitor, wherein a second terminal of the capacitor is connected to a first contact of the load switch, a second terminal of the second coil is connected to a second contact of the load switch, wherein the first surge arrestor is in parallel connection with the second coil of the transformer, wherein the amplitude of the injected pulse current of the second coil of the transformer is great than the rated load current of the said circuit breaker system, wherein the direction of injected pulse current is to reduce the current flowing through the two contacts of the load switch at a given direction, wherein when the current flowing between the two contacts of the load switch reaches to zero, the arc between the two contacts of the load switch is interrupted if the two contacts of the load switch is separated or disconnected, wherein the base frequency of the injected pulse current is between 2 kHZ and 1000 kHZ, wherein the stray inductance of the capacitor-the load switch-the second coil-loop is configured to minimize the resonant amplitude in the capacitor when the arc voltage between two contacts of the load switch is less than 80 Vp-p.

In accordance with one aspect of the present invention, there is provided an EBWF explosive bridge wire fuse which can interrupt very high current by controlled explosion in 100 microseconds comprising:

an upper terminal made of low electric resistance material, a lower terminal made of low electric resistance material, a bellows made of low electric resistance material, a spring, a sprint, a detonator, a piston made of electrical insulator, a insulated fuse case, wherein the top face of the bellows is electrically connected to the upper terminal, wherein the spring is inside of the bellows, wherein the piston is on the top of the detonator, the piston moves upwards when the detonator explodes, the piston compresses the bellows and the spring when the piston moves upwards, wherein the detonator is sealed inside of the lower terminal, wherein the sprint allows the piston move upwards freely, and the sprint prevents the piston moving downwards after the detonator is detonated, wherein the lower terminal has a ring-shaped flat top face, when the bellows and the spring are in free expansion, the bottom of the bellows is contacted firmly with the top face of the lower terminal, wherein when the bellows and the spring are compressed by the explosion force of the detonator, the bottom of the bellows is separated apart from the top face of the lower terminal, wherein the upper terminal has at least one vent which lets the air flow out from inside of the bellows when the bellows is compressed, wherein the upper terminal and the lower terminal are hold in positions by the insulated fuse case; wherein the bellows, the spring, the sprint, the detonator and the piston are enclosed inside of the insulated fuse case.

In accordance with one aspect of the present invention, there is provided a pulse current assisted circuit breaker system with EBWF which can interrupt both normal load current, overload current and high current comprising :

An EBWF explosive bridge wire fuse, a transformer, a capacitor with two terminals, a pulse generator with two output terminals, a first surge arrestor, a load switch with two contacts, wherein the transformer has a first coil and a second coil, each coil has two terminals, the two terminals of the first coil is connected to the two output terminals of the pulse generator, the injecting of the pulse current is performed by the pulse generator via the transformer, wherein a first terminal of the second coil is connected to a first terminal of the capacitor, wherein a second terminal of the capacitor is connected to a first contact of the load switch, a second terminal of the second coil is connected to a second contact of the load switch, wherein the first surge arrestor is in parallel connection with the second coil of the transformer, wherein the amplitude of the injected pulse current of the second coil of the transformer is great than the rated load current of the said circuit breaker system, wherein when the current flowing between the two contacts of the load switch reaches to zero, the arc between the two contacts of the load switch is interrupted if the two contacts of the load switch is separated or disconnected, wherein the base frequency of the injected pulse current is between 2 kHZ and 1000 kHZ, wherein the stray inductance of the capacitor-the load switch-the second coil-loop is configured to minimize the resonant amplitude in the capacitor when the arc voltage between the two contacts of the load switch is less than 80 Vp-p.

wherein the EBWF explosive bridge wire fuse can be triggered and detonated at any time; when it is detonated, the fuse is forced to be open-circuited in 100 microseconds, and the said circuit breaker system is forced to be open-circuited within 100 microseconds to interrupt the load current after the fuse is triggered.

In accordance with one aspect of the present invention, there is provided a multi-fuse holding and feeding system which can engage and dis-engage an fuse after each interruption detonated by controlled explosion comprising:

a movable fuse holder made of electrical insulator, a multiple fuses are mounted on the fuse holder, each fuse has two terminals; all the fuses mounted on the fuse holder are electrically insulated from each other, a first contact brush made of low electric resistance material, a second contact brush made of low electric resistance material, wherein at any moment, there is one fuse is positioned at a specific position, the specific position is defined as the engaged position, the fuse at the engaged position is defined as a engaged fuse, wherein at the engaged position, the first contact brush is pressed and contacted firmly with an upper terminal of the engaged fuse, the second contact brush is pressed and contacted firmly with a low terminal of the engaged fuse, all the remaining fuses mounted on the fuse holder are electrically insulated from each other and insulated from any parts of the said system, wherein the fuse holder can be moved by a mechanism, the mechanism can move any fuse mounted on the fuse holder to the engaged position;

wherein when the fuse holder moves, all fuses mounted on the fuse holder moves, there is no relatively movement between any fuse and the fuse holder, wherein the two contact brushes keep stationary while fuse holder moves, wherein when a fuse is moved to the engaged position, the previous engaged fuse is moved out of its previous position and becomes a dis-engaged fuse and disconnected with the two contact brushes, then the first contact brush is pressed and contacted firmly with an upper terminal of the newly engaged fuse, the second contact brush is pressed and contacted firmly with a low terminal of the newly engaged fuse, all the remaining fuses mounted on the fuse holder are electrically insulated from any parts of the said system.

BRIEF DESCRIPTION OF THE DRAWINGS

By way of example only, preferred embodiments of the present invention are described hereinafter with reference to the accompanying drawings, wherein.

DETAILED DESCRIPTION OF THE INVENTION

It is to be understood that the disclosure is not limited in its application to the details of the embodiments as set forth in the following description. The invention is capable of other embodiments and of being practiced or of being carried out in various ways.

Furthermore, it is to be understood that the terminology used herein is for the purpose of description and should not be regarded as limiting. Contrary to the use of the term "consisting", the use of the terms "including", "containing", "comprising", or "having" and variations thereof is meant to encompass the items listed thereafter and equivalents thereof as well as additional items. The use of the term "a" or "an" is meant to encompass "one or more". Any numerical range recited herein is intended to include all values from the lower value to the upper value of that range. And "contacts" of a load switch may be expressed as "terminals"; and terms "detonate", "trigger" and "explode" are used to describe a detonator related actions, or interrupting or disconnecting actions.

Graphics are used in order to simplify the descriptions. Most of the sizes or the parameters in the graphics are scaled for ease of understanding, or are normalized at given conditions. The graphics show a mutual contrast relationship instead of the actual sizes or values.

The directions and positions used in the description, such as up, down, vertically, horizontally, left, and right, are based on the relative directions and relative positions shown in the Figures, and are not necessarily the directions and positions in actual real-life applications.

Figure 1:
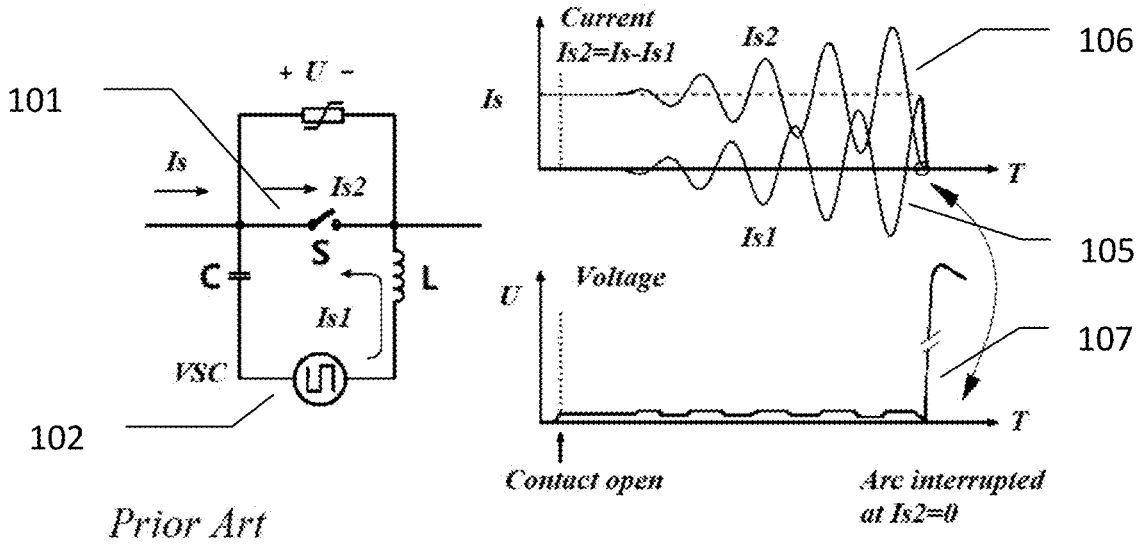
FIG. 1 is an illustration of a prior art circuit breaker and its waveforms.

FIG. 1 is a circuit diagram and waveforms of VSC (voltage source converter) based circuit breaker, which includes a VSC source 102, the VSC is in series connection with a capacitor C and inductor L to from a resonant circuit, wherein two terminals of the resonant circuit are connected to the two contacts of a load switch S 101 respectively; wherein the capacitor C, inductor L, load switch S 101 and VSC 102 form a series resonant L-C circuit loop with certain resonant frequency. When VSC is started, a resonance is initiated; then a resonant current occurs in the circuit loop. The resonant current flows through all parts in the resonant circuit loop (C, L and the load switch S) simultaneously; wherein the load switch S 101 is usually a vacuum circuit breaker or a VCB in short.

Figure 2:
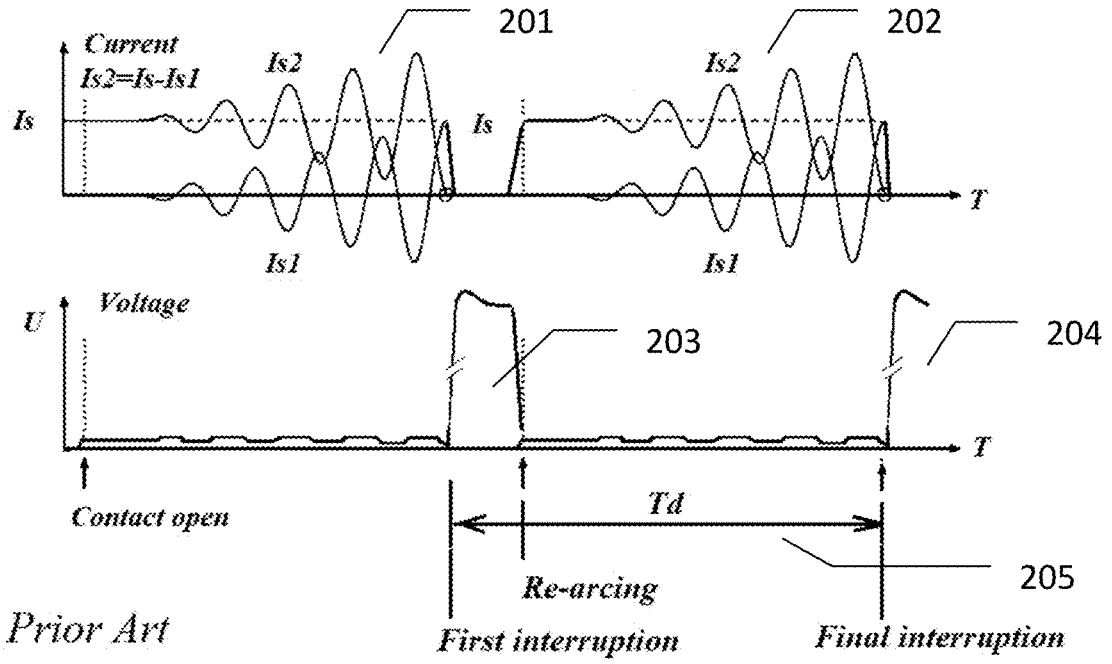
FIG. 2 is another illustration of prior art circuit breaker waveforms.

FIG. 2 shows the wave forms in the resonant circuit: Is is the load current of the system; and Is1 is the current 105 of the resonant circuit loop, and Is2 is the current 106 flows through the load switch S. And Is2=Is−Is1, whenever Is2=0, the arc in the load switch S is extinguished and current is interrupted in ideal conditions such as in a highly vacuumed chamber. The resonance stops when the current is fully interrupted (contacts of the load switch S are open and arc is extinguished). When the arc is not being interrupted, the voltage drop on the load switch S is usually less than 80 Vp-p, wherein p-p means peak-peak. When the arc is interrupted, the voltage drop on the load switch S jumps to the system voltage. The voltage U is the voltage between terminals (or contacts) of the load switch S, the interruption waveform of U is shown as 107 in FIG. 1. Where T axis is the time axis.

There is one major problems in the VSC assisted system in FIG. 1. If at the moment of Is2=0, the distance between contacts of the load switch is small, the extinguished arc may be ignited again, or a re-arcing may occur, then the circuit breaker interruption may fail in the first part of the cycle. In order to interrupt the load current, a second or even a third resonance has to be initiated. There is a delay time Td 205 between the first interruption 203 and the final interruption 204. In this situation, VSC initiates more than one resonance in one operation cycle; the two current resonances are shown as 201 and 202 in FIG. 2.

There is another major problem in the VSC assisted circuit breaker: when a short circuit occurs on load side, the final interruption is not always effective because the delay time Td 205, the load current may rocket to an unacceptable value within the time Td, a disastrous system failure will follow.

Figure 3:
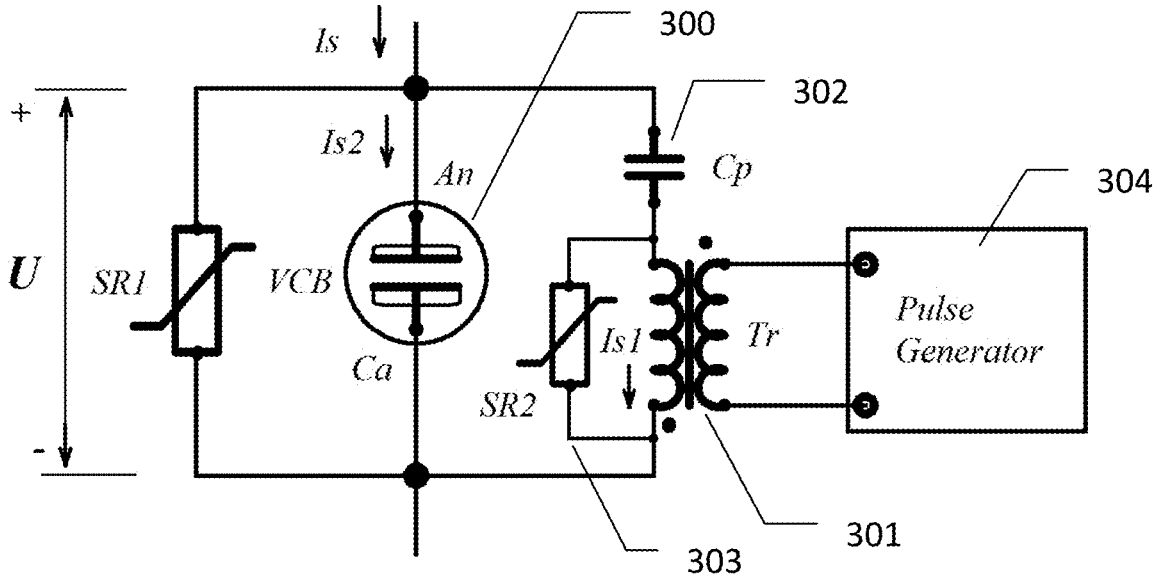
FIG. 3 is a circuit diagram of the present invention.

In order to overcome the above problems, a novel non-resonant circuit breaker is introduced. In the present invention, there is no resonant inductor L and resonant capacitor C. As shown in FIG. 3, a terminal of the second coil of a transformer is connected to a capacitor Cp in series, and two terminals of the transformer-capacitor circuit are connected to two contacts of the load switch VCB, a pulse generator is connected to the first coil of the transformer, pulse current is injected into the load switch VCB by the pulse generator. Wherein the capacitor Cp is a component used to block DC or low frequency current/voltage other than a resonant component. The novel circuit breaker detailed diagram is shown in FIG. 3.

Referring to FIG. 3, the transformer 301 has two coils, the second coil is connected to capacitor Cp 302 in series; the first coil of transformer 301 is connected to the pulse generator 304. The two terminals of the series-connected transformer-capacitor are connected to two terminals (or two contacts) of the load switch VCB 300 respectively. The VCB 300 has one anode (An) contact and a cathode (Ca) contact. The pulse generator 304 is connected to the first coil of the transformer 301 but electrically insulated with the VCB, pulse current is injected into the load switch VCB 300 by the pulse generator 304, wherein the capacitor Cp 302 is used to block DC or low frequency current/voltage and is not a resonant component. In the present invention, resonant L and resonant C are not used. A surge arrestor SR2 303 is connected to the second coil of the transformer 301 to suppress high voltage. A surge arrestor SR1 is connected to the anode and cathode of VCB 300 to suppress high voltage. Wherein SR1 is to withstand the high voltage of the system, and SR2 is only to withstand a lower voltage on second coil of the transformer 301 which is usually between 400V and 1000V. SR2 is much lower than SR1 in voltage rating.

In FIG. 3, load current is Is, VCB 300 current is Is2, injected current is Is1, voltage on the terminals of VCB 300 is U. The system voltage is usually between 1500V and 15000V, or higher. When the VCB switch 300 is fully opened and current is zero, U is equal to the system voltage.

Figure 4:
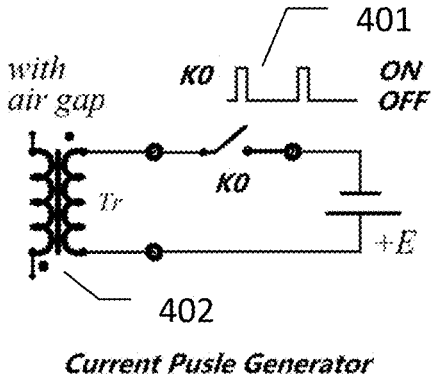
FIG. 4 is a diagram of current source configuration of the present invention.

FIG. 4 is an example of the pulse generator 304, wherein 304 is a current pulse generator, switch K0 is shown in FIG. 4 logically. The transformer 402 is a pulse current transformer with air-gap, the logic operation is shown as 401 in FIG. 4. The current is injected into the VCB at the transient of NO to OFF.

Figure 5:
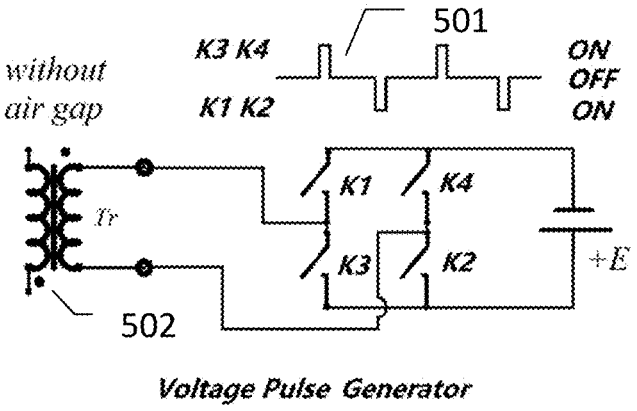
FIG. 5 is a diagram of voltage source configuration of the present invention.

FIG. 5 is an example of the pulse generator 304, wherein 304 is a voltage pulse generator, switch K1, K2, K3 and K4 are shown in FIG. 5 logically. The transformer 502 is a pulse voltage transformer without air-gap, the logic operations are shown as 501 in FIG. 5.

Figure 6:
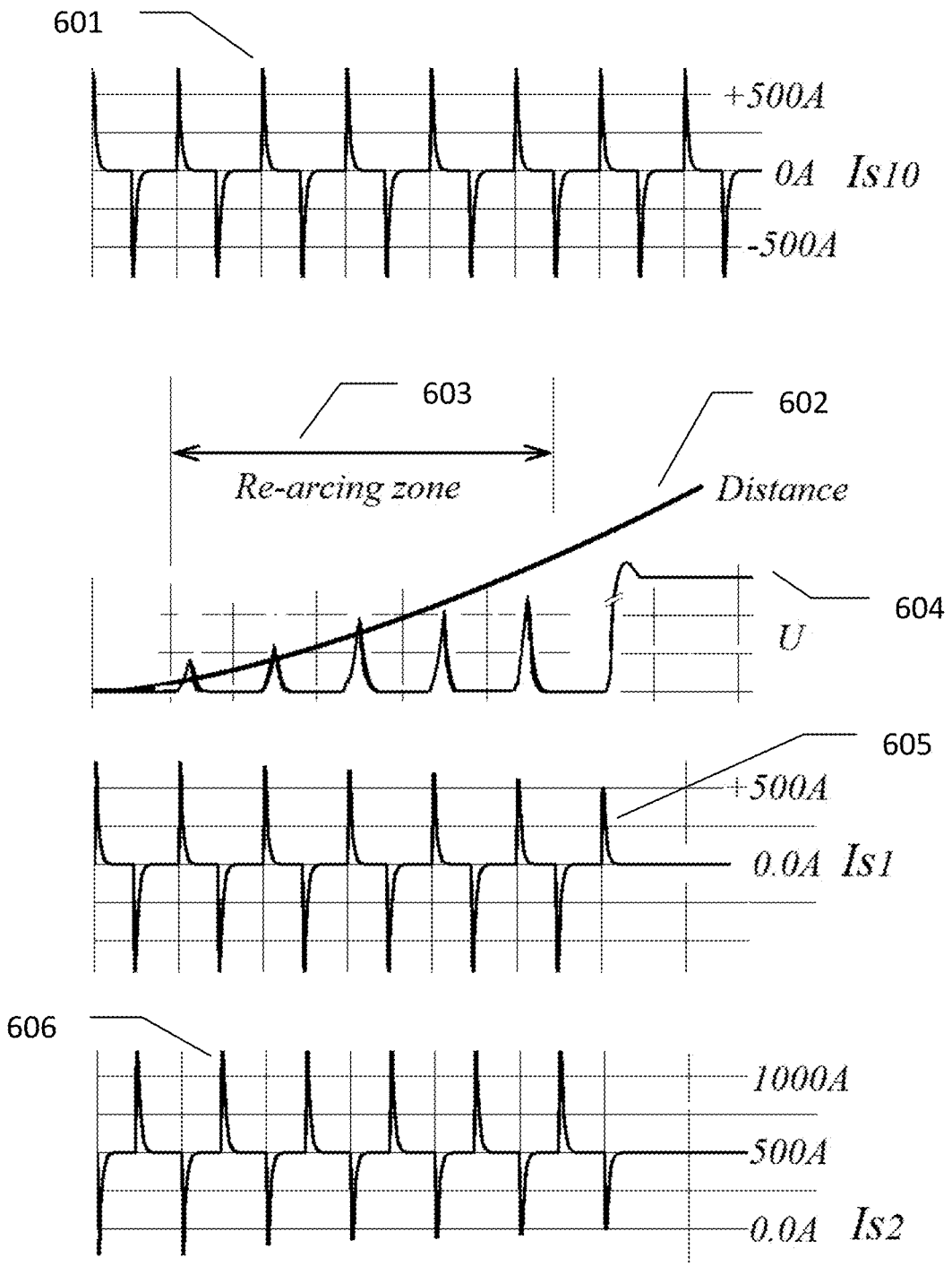
FIG. 6 is an illustration of operation waveforms of the present invention.

FIG. 6 shows one example of transit waveforms and relations of a typical current interruption of the present invention. In this example, the load current is supposed to be Is=500 A. Waveform 601 is the ideal injected current when contacts of the VCB are fully closed, which is marked as Is10. In order to interrupt the load current, the peak current of Is10 must be higher than the load current Is. The abscissa axis is the time axis.

The distance of the VCB contacts, or more specifically the distance of the anode and the cathode of VCB 300 is not constant during operation cycle, which is marked as 602 in FIG. 6. This distance is changing from 0 to full-open distance in an operation cycle, or in other words, in an interrupting cycle or disconnecting cycle.

Is2 equals to load current Is minus injected current Is1, whenever Is2=0, the current in VCB 300 is interrupted. But the interrupted current/arc may be re-ignited or re-initiated if the distance 602 is not big enough. The interruption is secured only when the distance 602 reaches a certain value and VCB 300 current Is2 falls to zero. These relations are expressed in 602, 604, 605 and 606 in FIG. 6. Where 604 is the voltage U between anode and cathode of VCB 300, 605 is the current Is1 injected into VCB 300 by the transformer and pulse generator, 606 is the resulting current Is2 in VCB 300. It is noticeable that Is1 in 605 is different from Is10 in 601 because the distance 602 of contacts of VCB 300 influences the injected current.

In 602 and 604 of FIG. 6, It can be seen that there are multiply interruptions and re-arcings (re-ignitions) in an operation cycle. This zone is marked as Re-arcing Zone 603. The final (secured) interruption is appearing after the re-arcing zone.

Compare 203/204 in FIG. 2 of the prior art and 604 in FIG. 6 of the present invention, the load current interruption in the switch S (prior art) and VCB 300 (present invention) are based on different key factors: in prior art, interruption is decided by distance of contacts and resonance current, the timing and amplitude of resonance current in turn is decided by VSC and the distance of the switch S contacts; while in present invention, interruption is decided by distance of contacts of VCB 300 and injected current, and the timing and amplitude of the injected current is much more predictable and controllable than in a resonant circuit. The base frequency of the injected current is independent of any resonance; that is the key advantage of present invention. It is noticeable that the delay time Td is much longer in the prior art than the time between two interruptions in the re-acring zone 603 of the present invention. This means that the present solution is much faster than prior art in interrupting a same load current.

Refer again to FIG. 6, if the load current Is is very high, which always happens when there is a load-side fault such as short-circuit or load surge, the injected current Is1 is not higher enough to overcome the load current, the VCB 300 interruption is going to fail. In order to solve this problem, an EBWF (explosive bridge wire fuse) is introduced to cut off high load current which is higher than injected current Is1.

For example, when the injected current is 1000 A, the maximum interruption capacity is 1000 A, the system can cut off a load current below 1000 A. When a load fault current is over 1000 A, this system cannot cut off the load in time.

An EBWF is a fuse which can be disconnected or interrupted by a controlled explosive. An EBWF can interrupt most high current in 100 microseconds (100 us). EBWF is a non-recoverable fuse which is controlled by a high electric pulse, (or triggered, detonated by a control signal). In the following description, both term EBWF or EBWF fuse has same meaning.

Figure 7:
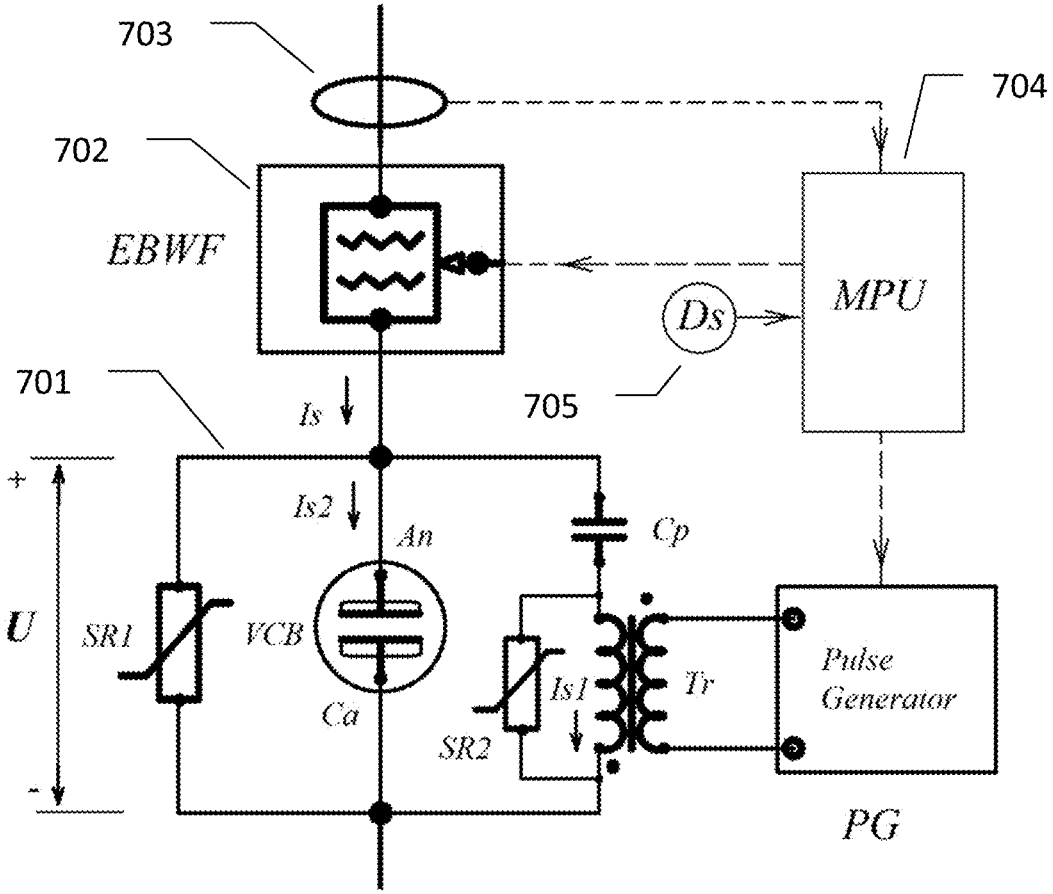
FIG. 7 is a diagram of a circuit breaker with an explosive bridge wire fuse EBWF and controls of the present invention.

A novel system with EBWF is shown in FIG. 7. The basic part 701 of the system is the same as the diagram in FIG. 3. Where an EBWF fuse 702, a current sensor 703, a control unit MPU 704 and a Ds unit 705 to receive operation signals are added on the basic part 701. Wherein the pulse generator is marked as PG. The Ds 705 is usually connected to a higher level of controls such as the central control room.

The system in FIG. 7 is working in the following way:

1, When a Ds signal to disconnect the VCB is received, the MPU orders the PG to inject pulse current into the VCB, and MPU starts the disconnecting mechanism of the VCB at same time. The disconnecting mechanism means a mechanical actuator or gear to separate the two contacts of VCB, which is not shown in the figures.

2, When the load current detected by the current sensor 703 is within the capacity of the PG, the MPU controls the PG to inject proper current, a normal load current interruption is processed.

3, When the load current detected by the current sensor 703 is higher than the capacity of the PG, the MPU sends a interruption signal to the EBWF, a fast and non-recoverable interruption is processed.

4, Whenever load-side short circuit is detected by the current sensor 703, the MPU sends a interruption signal to EBWF regardless the PG capacity, a fast and non-recoverable interruption is processed as the highest priority.

5, In normal working conditions, the MPU calculates the detected current from 703 based on pre-set I2T curves (amp squares and multiplies time T), interruption orders are sent to both VCB mechanism and PG, a normal overload interruption is processed.

Figure 8:
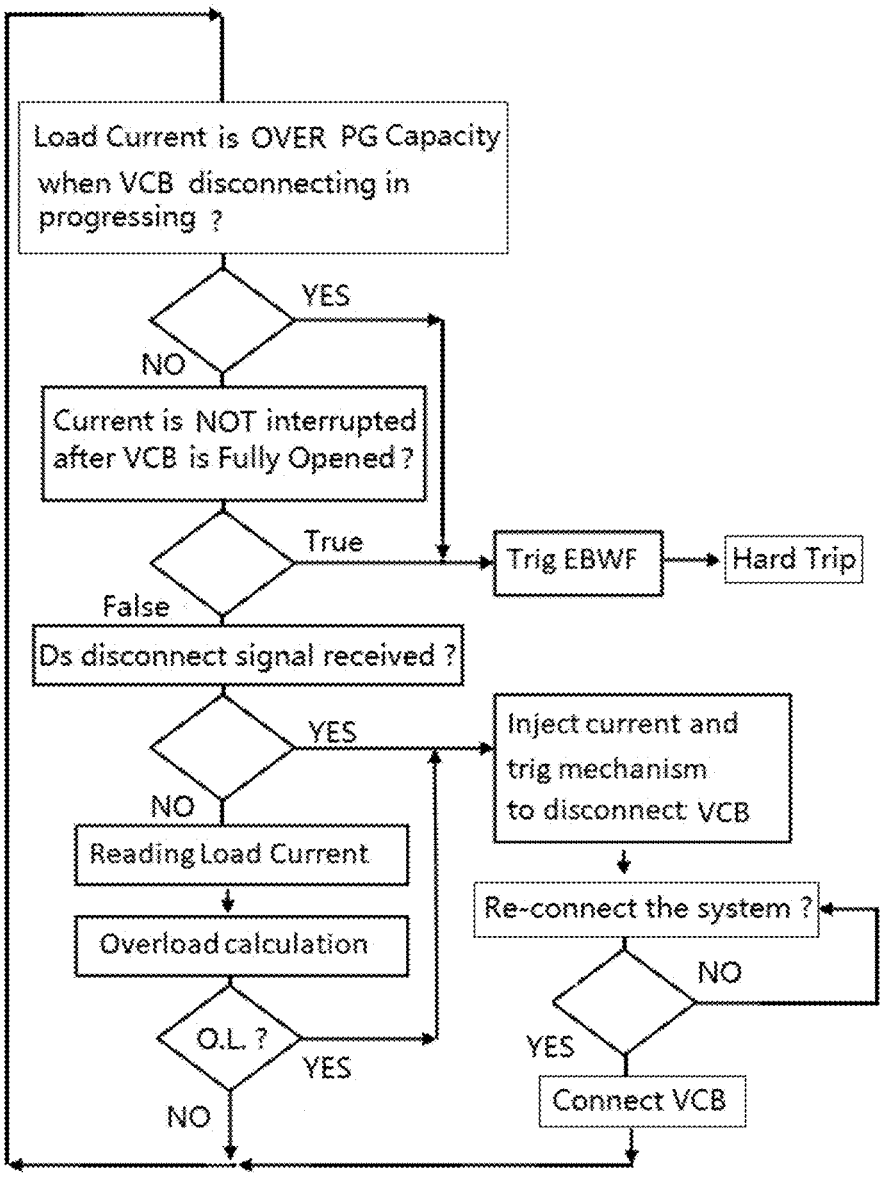
FIG. 8 is a logic diagram of the circuit breaker with an explosive bridge wire fuse of the present invention.

A logic diagram of one working sequence is shown in FIG. 8. Where a hard trip means the system is tripped and cannot be reset or recovered unless manual operation is involved. Wherein the signal of Ds 705 can be of disconnecting the VCB or connecting the VCB. Wherein the short term "O.L." means "Overload".

Figure 9A:
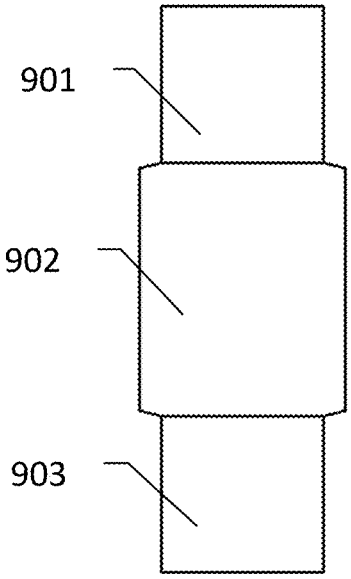
FIG. 9A is an illustration of an embodiment of EBWF fuse in the present invention.

FIG. 9A shows an example of EBWF fuse of the present invention which has two terminals and a case or body. Where 901 is the upper terminal of the fuse which is made of low electric resistance metal, 903 is the lower terminal of the fuse which is made of low electric resistance metal, and 902 is the insulated fuse case or body which holds the two terminals together and encloses parts inside the fuse.

Figure 9B:
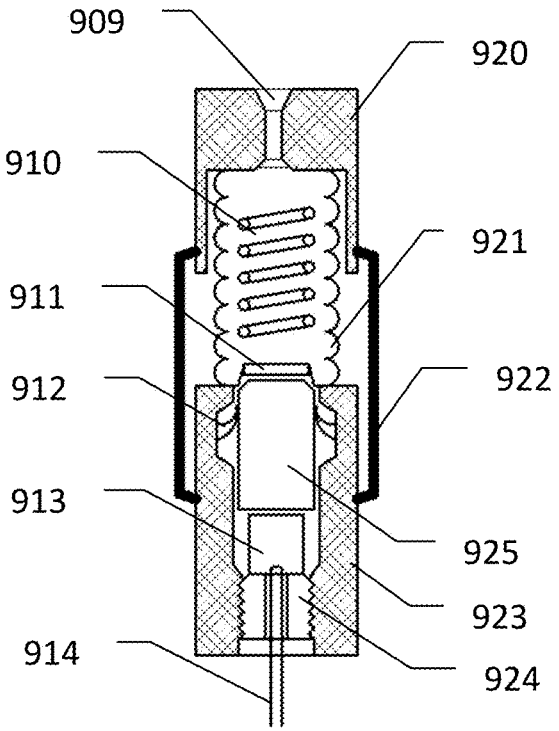
FIG. 9B is a section view of the EBWF embodiment in the present invention.

FIG. 9B is a section view of the fuse in FIG. 9A. Part 920 is the upper terminal of the fuse. Part 921 is a bellows made of low electric resistance metal, the bellows 921 can be stretched (expanded) or compressed in vertical direction. When the bellows 921 is stretched or expanded, it is firmly contacted with top face of the lower terminal 923; when the bellows 921 is compressed, it is separated with the lower terminal 923. Part 910 is a spring which increases the contacting force between the bellows 921 and the lower terminal 923. Part 925 is a piston made of insulation material, part 912 is a restriction sprint which allows the piston 925 move upwards freely but prevents the piston 925 from moving downwards after 925 reaches its upmost position. Part 913 is a detonator and its explosion can be triggered or detonated by a sharp electric pulse. Part 924 is a bottom sealing part which seals the detonator inside the lower terminal 923. Part 914 is the control cable of the detonator 913; the detonator is triggered or detonated when a sharp electric pulse is input into cable 914. Part 911 is a piece of hard metal attached on the bottom of bellows 921, the part 911 prevents the piston 925 from penetrating into the bellows 921. And 922 is the fuse case or fuse body which holds the two terminals together and insulated. Part 922 is made of high insulation material and has high strength to withstand the explosive force of the detonator 913. Vent 909 is open channel which allows air or gas inside of bellows 921 to vent when the bellows is compressed.

Figure 9C:
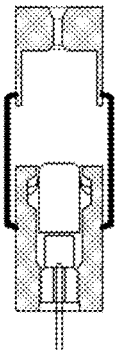
FIG. 9C is a simplified illustration of the EBWF embodiment in the present invention without showing the upper parts.

FIG. 9C shows the section view of the lower part of the EBWF fuse without showing the upper terminal and its connected parts.

Figure 9D:
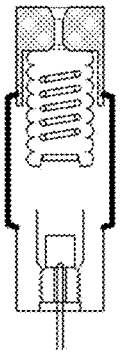
FIG. 9D is a simplified illustration of the EBWF embodiment in the present invention without showing the lower parts.

FIG. 9D shows the section view of the upper part of the EBWF fuse without showing the lower terminal and its connected parts.

Figure 9E:
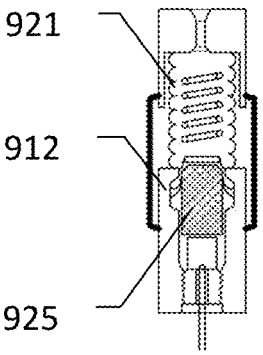
FIG. 9E is an illustration of the piston and sprint of the EBWF before the fuse is detonated in the present invention.

FIG. 9E shows the section view of the EBWF fuse before the fuse is triggered or detonated (before the detonator explodes). Piston 925 and sprint 912 is at their origin positions, the bellow 921 is firmly contacted with the lower terminal of the fuse.

Figure 9F:
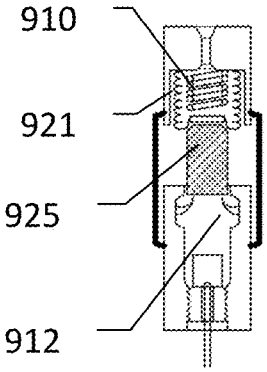
FIG. 9F is an illustration of the compressed bellows, spring, piston and sprint of the EBWF after the fuse is detonated in the present invention.

FIG. 9F shows the section view of the EBWF fuse after it is triggered (after the detonator exploded). Piston 925 is moved upwards by the detonator, and sprint 912 is at its released position which blocks the piston 925 from mowing downwards, the bellow 921 is separated with the lower terminal. The separation distance is at least the length of the insulation piston 925. After the detonator is triggered or detonated, the fuse is open-circuited and no current will follow between the upper terminal and the lower terminal, or in other words the EBWF fuse is interrupted. Wherein 910 is the compressed spring.

The detonator 913 explosion takes about 10-100 microseconds (10 us-100 us) after it is triggered, the upper terminal and the lower terminal is forced to be open-circuited in 10 us to 100 us, this will make the load current interrupted in 10 us to 100 us, no significant arcing will be imposed inside the fuse if the interruption is fast enough. This is the fasted mechanic circuit interrupter have ever achieved. The similar technology has been used in real fault current limitation application in ABB since 1955, in ABB's application it uses a detonator to blow-off the piece of conductor other than pushing a bellows apart from one contacted terminal. The detonator is very reliable because the detonation can be made only at a high current (>200 A) and high di/dt (>100 A/us).

The major disadvantage of EBWF is that the fuse is not self-recoverable and has to be replaced after each interruption. The present invention further provides a simple solution which combines multiple EBWF fuse units together, the combined mechanism moves forward one position to make the circuit re-closed by an intact fuse after an explosive interruption is made. In following description, term "fuse" means "EBWF fuse" or vice versa. The mechanism is also named as a fuse holding and feeding system.

Figure 10:
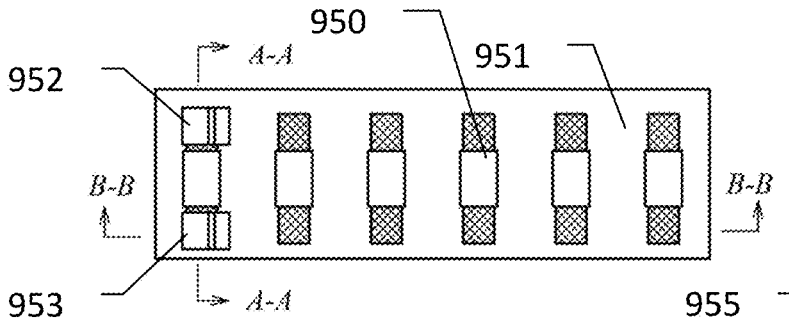
FIG. 10 is an illustration of a rectangular fuse holder in the present invention.

FIG. 10 shows one example of a rectangular block holder combined system, 950 is an EBWF fuse, 951 is a fuse holder, there are multiple fuse units mounted on holder 951. Part 952 is a first contact brush; part 953 is a second contact brush. Part 952 and part 953 are respectively firmly contacted with two terminals of a fuse which is engaged.

Figure 10A:
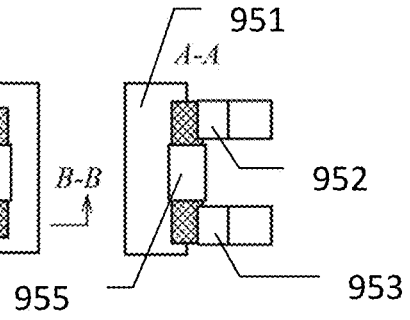
FIG. 10A is a section view illustration of the rectangular fuse holder in the present invention.

FIG. 10A shows one section view of the combined system, 951 is the fuse holder. Fuse 955 is the engaged fuse. The first contact brush 952 is firmly contacted with upper terminal of 955, the second contact brush 953 is firmly contacted with lower terminal of 955. The engaged fuse is a fuse and the only fuse among the fuses mounted on the fuse holder, its upper and lower terminals are electrically contacting with the two contact brushes.

Figure 10B:
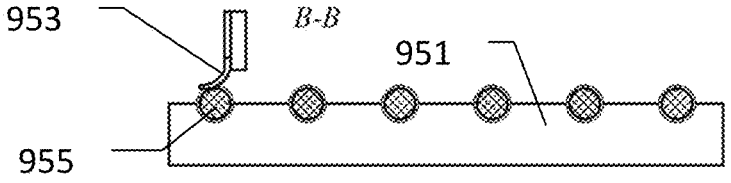
FIG. 10B is another section view illustration of the rectangular fuse holder in the present invention.

FIG. 10B shows another section view of the combined system, 955 is the engaged fuse, 951 is the fuse holder, there are multiple fuse units mounted on fuse holder 951. The second contact brush 953 is firmly contacted with the lower terminal of 955.

When the first contact brush 952 is firmly contacted with upper terminal of 955, the second contact brush 953 is firmly contacted with lower terminal of 955, the engaged fuse then can be connected into a working circuit loop via the contact brushes. In referring to part 702 in FIG. 7, the said engaged fuse is also the fuse that can take the position and functions of EBWF 702 in the circuit by selectively contacting two terminals of fuse with two contact brushes.

Each time after an interruption is triggered or detonated, the engaged fuse is detonated and is open-circuited. The fuse holder 951 is pushed forward exactly one specific position by a mechanism, then the said engaged fuse is cut off the circuit, a second fuse will take the position of the engaged fuse, and the second fuse becomes a newly engaged fuse. In this way, each time when the fuse holder is moved forward a position, one detonated fuse will be cut off from the circuit connecting to the two contact brushes, and a new fuse will be connected into the said circuit. The mechanism can be a motor, a manual operated gear or a switching handle. The mechanism is not shown is the Figures.

In this way, the whole interruption system in FIG. 7 can be operated automatically or semi-automatically. Human interference (replace the interrupted fuses) is needed only when all fuses in one fuse holder have been detonated, usually this will happen once every several months or years.

Figure 11:
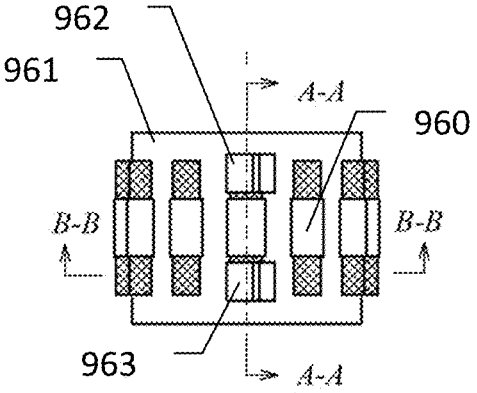
FIG. 11 is an illustration of a cylinder fuse holder in the present invention.
Figure 11A:
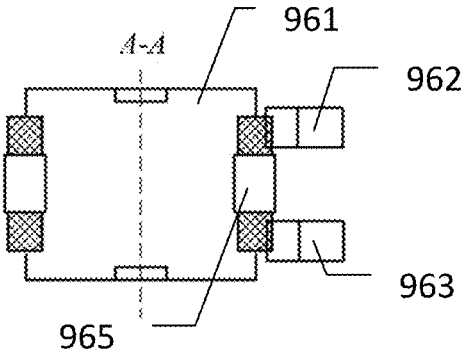
FIG. 11A is a section view illustration of the cylinder fuse holder in the present invention.

FIG. 11 shows another example of a cylinder holder combined system, 960 is an EBWF fuse, 961 is a fuse holder, there are multiple fuse units mounted on fuse holder 961. Part 962 is a first contact brush; part 963 is a second contact brush. Part 962 and part 963 are respectively firmly contacted with two terminals of a fuse which is engaged FIG. 11A shows one section view of the combined system, 961 is the fuse holder. Fuse 965 is the engaged fuse. The first contact brush 962 is firmly contacted with the upper terminal of 965, the second contact brush 963 is firmly contacted with lower terminal of 965. The engaged fuse is a fuse and the only fuse among the fuses mounted on the fuse holder, its upper and lower terminals are electrically contacting with the two contact brushes.

Figure 11B:
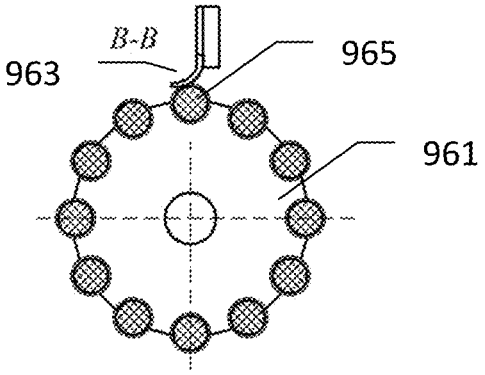
FIG. 11B is another section view illustration of the cylinder fuse holder in the present invention.

FIG. 11B shows another section view of the combined system of FIG. 11. 965 is the engaged fuse, 961 is the fuse holder, there are multiple fuse units mounted on fuse holder 961. The second contact brush 963 is firmly contacted with the lower terminal of the engaged fuse 965.

When the first contact brush 962 is firmly contacted with upper terminal of 965, the second contact brush 963 is firmly contacted with lower terminal of 965, the engaged fuse then can be connected into a working circuit loop by the contact brushes. In referring to part 702 in FIG. 7, the said engaged fuse is the fuse can take the position and functions of EBWF 702 in the circuit by selectively contacting two terminals of the fuse with two contact brushes.

Each time after an interruption is triggered or detonated, the engaged fuse is detonated and is open-circuited. The fuse holder 961 is pushed forward exactly one specific position by a mechanism, then the said engaged fuse is cut off the circuit, a second fuse will take the position of the engaged fuse, and the second fuse becomes a newly engaged fuse. In this way, each time when the fuse holder is moved forward a position, one detonated fuse will be cut off from the circuit connecting to the two contact brushes, and a new fuse will be connected into the said circuit. The mechanism can be a motor, a manual operated gear or a switching handle. The mechanism is not shown is the Figures.

In this way, the whole interruption system in FIG. 7 can be operated automatically or semi-automatically. Human interference (replace the interrupted fuses) is needed only when all fuses in one fuse holder have been detonated, usually this will happen once every several months or years.

Figure 12:
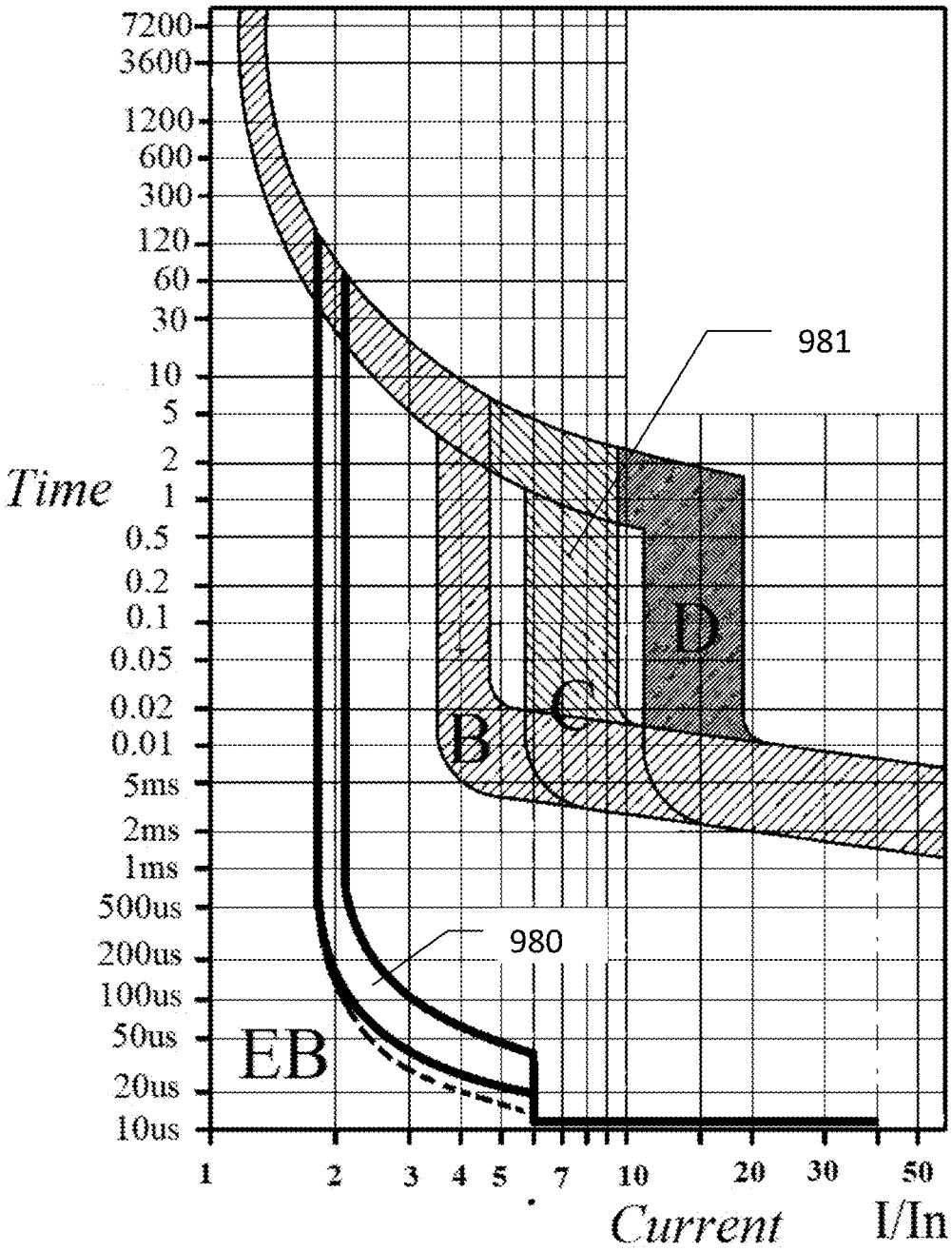
FIG. 12 is an I2T interruption curve comparison of different circuit breakers.

FIG. 12 is a comparison of the I2T curves (amp squares multiplies time T) of the present invention and conventional circuit breakers. Where curve EB 980 is of the present invention system, curves 981 (curve B, C and D) are of conventional circuit breakers. It can be seen that present invention can cut normal load current, overload current and short-circuit current very fast, the EB curves can be pre-set flexibly by the MPU 704.

Figure 13:
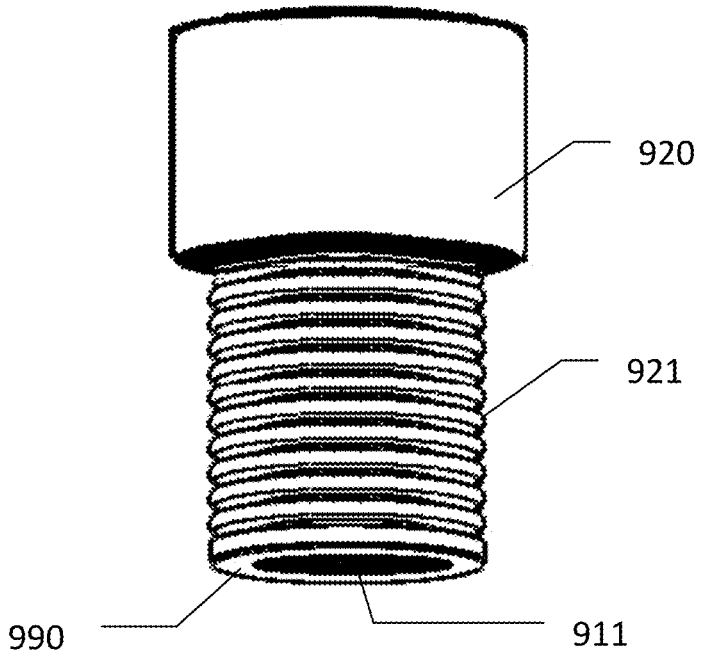
FIG. 13 is another view of a bellows of the EBWF fuse in the present invention.

FIG. 13 is an additional explanation of the upper terminal and the bellows in FIG. 9B. Where 920 is the upper terminal of the fuse, it is made of low electric resistance material, it is smooth in surface which can be securely contacted with a contact brush. Wherein 921 is the bellows, it is made of low electric resistance material, and has low mechanical resistance in expansion and compression. The bellows has a flat surface 990 at the bottom which can be contacted with the top surface of 923 securely when in free expansion statue. The bellows is mechanically enhanced by part 911 at the bottom.

The invention claimed is:

1. A pulse current assisted circuit breaker system comprising:

a transformer, a capacitor with two terminals, a pulse generator with two output terminals, a first surge arrestor, a load switch with two contacts, wherein the transformer has a first coil and a second coil, each coil has two terminals, the two terminals of the first coil are connected to the two output terminals of the pulse generator, injecting of the pulse current is performed by the pulse generator via the transformer, wherein a first terminal of the second coil is connected to a first terminal of the capacitor, wherein a second terminal of the capacitor is connected to a first contact of the load switch, a second terminal of the second coil is connected to a second contact of the load switch, wherein the first surge arrestor is in parallel connection with the second coil of the transformer, wherein an amplitude of an injected pulse current of the second coil of the transformer is greater than an amplitude of a rated load current of the said circuit breaker system, wherein a direction of injected pulse current is to reduce a current flowing through the two contacts of the load switch at a given direction, wherein when the current flowing between the two contacts of the load switch reaches to zero, an arc between the two contacts of the load switch is interrupted if the two contacts of the load switch are separated or disconnected, wherein a base frequency of the injected pulse current is between 2 kHZ and 1000 kHZ, wherein a stray inductance of a loop formed by the capacitor, the load switch, and the second coil is configured to minimize a resonant amplitude in the capacitor when an arc voltage between two contacts of the load switch is less than 80 Vp-p.

2. The pulse current assisted circuit breaker system of claim 1:

wherein the pulse generator is a current source pulse generator, the pulse generator is electrically insulated with the load switch.

3. The pulse current assisted circuit breaker system of claim 1:

wherein the pulse generator is a voltage source pulse generator, the pulse generator is electrically insulated with the load switch.

4. The pulse current assisted circuit breaker system of claim 1:

wherein the injecting of the current pulse is started from the beginning of disconnecting of the two contacts of the load switch and is ended after the arc between two contacts of the load switch is fully interrupted.

5. The pulse current assisted circuit breaker system of claim 1:

wherein the base frequency of the injected current pulse is independent of a capacitance of the capacitor.

6. The pulse current assisted circuit breaker system of claim 1:

wherein a second surge arrestor is connected in parallel with the load switch, the load switch is a VCB vacuum circuit breaker, and the given direction of the current is a direction of the load current.

7. A EBWF explosive bridge wire fuse comprising:

an upper terminal made of low electric resistance material, a lower terminal made of low electric resistance material, a bellows made of low electric resistance material, a spring, a sprint, a detonator, a piston made of electrical insulator, an insulated fuse case, wherein a top face of the bellows is electrically connected to the upper terminal, wherein the spring is inside of the bellows, wherein the piston is on a top of the detonator, the piston moves upwards when the detonator explodes, the piston compresses the bellows and the spring when the piston moves upwards, wherein the detonator is sealed inside of the lower terminal, wherein the sprint allows the piston to move upwards freely, and the sprint prevents the piston moving downwards after the detonator is detonated, wherein the lower terminal has a ring-shaped flat top face, when the bellows and the spring are in free expansion, a bottom of the bellows is contacted firmly with the top face of the lower terminal, wherein when the bellows and the spring are compressed by an explosion force of the detonator, the bottom of the bellows is separated apart from the top face of the lower terminal, wherein the upper terminal has at least one vent which lets air flow out from inside of the bellows when the bellows is compressed, wherein the upper terminal and the lower terminal are held in position by the insulated fuse case; wherein the bellows, the spring, the sprint, the detonator, and the piston are enclosed inside of the insulated fuse case.

8. The EBWF explosive bridge wire fuse of claim 7:

wherein the detonator is triggered to detonate by a sharp electrical pulse, the detonator explodes within 4 microseconds after it is triggered; and the explosion force pushes the piston to separate the bellows apart from the lower terminal within 100 microseconds.

9. The EBWF explosive bridge wire fuse of claim 7:

wherein the EBWF fuse is in series connection with a load to be interrupted.

10. The EBWF explosive bridge wire fuse of claim 7:

wherein the detonator has an electric cable which is to be connected to an electric trigger source; the detonator can be triggered or detonated by a sharp electric pulse with high di/dt; the action of detonation of the detonator is a controlled explosion.

11. A pulse current assisted circuit breaker system with an EBWF explosive bridge wire fuse, comprising:

a transformer, a capacitor with two terminals, a pulse generator with two output terminals, a first surge arrestor, a load switch with two contacts, wherein the transformer has a first coil and a second coil, each coil has two terminals, the two terminals of the first coil are connected to the two output terminals of the pulse generator, injecting of the pulse current is performed by the pulse generator via the transformer, wherein a first terminal of the second coil is connected to a first terminal of the capacitor, wherein a second terminal of the capacitor is connected to a first contact of the load switch, a second terminal of the second coil is connected to a second contact of the load switch, wherein the first surge arrestor is in parallel connection with the second coil of the transformer, wherein an amplitude of an injected pulse current of the second coil of the transformer is greater than an amplitude of a rated load current of the said circuit breaker system, wherein when a current flowing between the two contacts of the load switch reaches to zero, an arc between the two contacts of the load switch is interrupted if the two contacts of the load switch are separated or disconnected, wherein a base frequency of the injected pulse current is between 2 kHZ and 1000 kHZ, wherein a stray inductance of a loop formed by the capacitor, the load switch, and the second coil is configured to minimize a resonant amplitude in the capacitor when an arc voltage between the two contacts of the load switch is less than 80 Vp-p, wherein the EBWF explosive bridge wire fuse can be triggered and detonated at any time; when it is detonated, the fuse is forced to be open-circuited in 100 microseconds, and the said circuit breaker system is forced to be open-circuited within 100 microseconds to interrupt a load current after the fuse is triggered.

12. The pulse current assisted circuit breaker system with EBWF of claim 11:

wherein the EBWF explosive bridge wire fuse is detonated to be open-circuited during a disconnecting action of the load switch when the load current cannot be interrupted by the injected pulse current.

13. The pulse current assisted circuit breaker system with EBWF of claim 11:

wherein the EBWF explosive bridge wire fuse is detonated to be open-circuited when the load current is not interrupted after the contacts of the load switch are fully opened.

14. The pulse current assisted circuit breaker system with EBWF of claim 11:

wherein the EBWF explosive bridge wire fuse is detonated to be open-circuited when the load current reaches or exceeds a pre-set maximum current.

15. The pulse current assisted circuit breaker system with EBWF of claim 11:

wherein the load switch is a VCB vacuum circuit breaker.

16. The pulse current assisted circuit breaker system with EBWF of claim 11:

where the EBWF fuse is installed in a multi-fuse holding and feeding system, the holding and feeding system further comprises a movable fuse holder made of an electrical insulator, multiple EBWF fuses are mounted on the fuse holder, each fuse has two terminals; all the fuses mounted on the fuse holder are electrically insulated from each other, a first contact brush made of low electric resistance material, a second contact brush made of low electric resistance material, wherein at any moment, there is one fuse positioned at a specific position, the specific position is defined as the engaged position, the fuse at the engaged position is defined as an engaged fuse, wherein at the engaged position, the first contact brush is pressed and contacted firmly with an upper terminal of the engaged fuse, the second contact brush is pressed and contacted firmly with a low terminal of the engaged fuse, all the remaining fuses mounted on the fuse holder are electrically insulated from each other and insulated from any parts of the said multi-fuse holding and feeding system, wherein the fuse holder can be moved by a mechanism, the mechanism can move any fuse mounted on the fuse holder to the engaged position;

wherein when the fuse holder moves, all fuses mounted on the fuse holder move, there is no relative movement between any fuse and the fuse holder, wherein the two contact brushes remain stationary while the fuse holder moves, wherein when a fuse is moved to the engaged position, the previous engaged fuse is moved out of its previous position and becomes a dis-engaged fuse and is disconnected with the two contact brushes, then the first contact brush is pressed and contacted firmly with an upper terminal of the newly engaged fuse, the second contact brush is pressed and contacted firmly with a low terminal of the newly engaged fuse, all the remaining fuses mounted on the fuse holder are electrically insulated from any parts of the said multi-fuse holding and feeding system.

17. The pulse current assisted circuit breaker system of claim 16, wherein the mechanism is driven by an electric motor.

18. The pulse current assisted circuit breaker system of claim 16, wherein the mechanism is driven by human hand or human force.

19. The pulse current assisted circuit breaker system of claim 16, wherein the fuse holder is a cylinder, all the fuses are mounted on an outer cylinder surface and with their terminals facing outwards, the cylinder can be rotated around its axial center.

20. The pulse current assisted circuit breaker system of claim 16, wherein the fuse holder is a rectangular insulator block, all the fuses are mounted on one surface of the block and with their terminals facing outwards of the surface, the block can be moved along the said surface.

* * * * *